US006669294B2

(12) United States Patent
Kinoshita et al.

(10) Patent No.: US 6,669,294 B2
(45) Date of Patent: Dec. 30, 2003

(54) CHAIR

(75) Inventors: Yojiro Kinoshita, Osaka (JP); Nobuyuki Ueda, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 0 days.

(21) Appl. No.: 10/130,744

(22) PCT Filed: Oct. 3, 2001

(86) PCT No.: PCT/JP01/08733

§ 371 (c)(1),
(2), (4) Date: May 23, 2002

(87) PCT Pub. No.: WO02/32265

PCT Pub. Date: Apr. 25, 2002

(65) Prior Publication Data

US 2002/0180250 A1 Dec. 5, 2002

(30) Foreign Application Priority Data

Oct. 16, 2000 (JP) ..... 2000-315767

(51) Int. Cl.[7] ..... B60N 2/02

(52) U.S. Cl. ..... 297/354.1; 297/61; 297/354.12; 297/301.1

(58) Field of Search ..... 297/354.1, 354.12, 297/301.1, 301.7, 300.1, 300.2, 316, 320, 61

(56) References Cited

U.S. PATENT DOCUMENTS

| | | | | | |
|---|---|---|---|---|---|
| 2,558,171 | A | * | 6/1951 | Chesley | 297/354.1 X |
| 3,416,839 | A | * | 12/1968 | Flint | 297/301.1 X |
| 5,597,203 | A | * | 1/1997 | Hubbard | 297/301.1 |
| 6,056,361 | A | * | 5/2000 | Cvek | 297/300.2 |
| 6,257,665 | B1 | * | 7/2001 | Nagamitsu et al. | 297/354.1 X |

FOREIGN PATENT DOCUMENTS

| | | |
|---|---|---|
| JP | 50251/1982 | 3/1982 |
| JP | 187947/1988 | 12/1988 |
| JP | 2-257910 A | 10/1990 |

* cited by examiner

*Primary Examiner*—Anthony D. Barfield
(74) *Attorney, Agent, or Firm*—Banner & Witcoff Ltd.

(57) ABSTRACT

A chair wherein a backrest frame 5 located rearwardly of a seat frame 4 is divided into a backrest upper frame 55 and a backrest lower frame 50, at least the backrest upper frame 55 being capable of inclining rearwardly, is of a construction that shafts 8 and 71 for rearwardly inclining the backrest upper frame 55 are provided to allow the backrest upper frame 55 to incline rearwardly about one of the shafts 8 and 71. The chair of this construction is made more comfortable to sit.

4 Claims, 4 Drawing Sheets

CHAIR

CROSS REFERENCE TO RELATED APPLICATIONS:

This is a U.S. National Phase Application under 35 U.S.C. §371 and applicant herewith claims the benefit of priority of PCT/JP01/08733 filed Oct. 3, 2001, which was published Under PCT Article 21(2) in Japanese, which claims priority to Japanese Application No. P2000-315767, filed Oct. 16, 2000, the entire contents of which are incorporated herein by reference.

TECHNICAL FIELD

The present invention relates to chair structures and, more specifically, to a chair made more comfortable to sit.

BACKGROUND ART

Among chairs presently used in offices and the like, there exist chairs of the type which is capable of bending an upper portion of its back rearwardly. Such a chair, which allows the backbone of a person sitting thereon to bend backwardly thereby refreshing the sitting person, is generally of a construction having a shaft for rotation mounted intermediate between upper part and lower part of the backrest portion to allow a back portion above the shaft for rotation to incline rearwardly about the shaft for rotation.

With such a conventional construction having a shaft for rotation intermediate between the upper and lower parts of the backrest portion, however, the radius of gyration with which the upper back portion is inclined rearwardly is small and, hence, the upper end side of the upper back portion largely leans rearwardly. Consequently, when the upper back portion thus constructed is inclined rearwardly, it cannot support the shoulders or parts therearound of the sitting person and, hence, this condition is substantially the same as the absence of the upper back portion, making the sitting person unstable. Further, the provision of the shaft for rotation intermediate between the upper and lower parts of the backrest portion raises a problem that the load of the sitting person is concentrated on the shaft for rotation because the backrest portion steeply bends about the shaft, thus making the sitting person feel uncomfortable or giving him or her a sense of incongruity or the like.

With a view to solving the aforementioned problems, the present invention intends to provide a chair which is capable of inclining its back portion rearwardly while offering improved comfortableness to sit.

DISCLOSURE OF INVENTION

With a view to solving the foregoing problems, the present invention provides a chair wherein a back portion located rearwardly of a seat portion is divided into an upper back portion and a lower back portion, at least the upper back portion being capable of inclining rearwardly, characterized in that a fulcrum for rearwardly inclining the upper back portion is located below a seating surface, the upper back portion being allowed to incline rearwardly about the fulcrum.

Since the fulcrum for rearwardly inclining the upper back portion is located below the seat portion, the upper back portion can be moved rearwardly while rearwardly inclining gently, whereby the shoulders and parts therearound of a person sitting on the chair can be contacted and supported by the upper end side of the upper back portion.

The angle of rearward inclination of the upper back portion may vary depending upon the build, posture or preference of the sitting person. In such a case, it is sufficient to provide a plurality of fulcrums for rearwardly inclining the upper back portion below the seating surface for the sitting person to select any one of the fulcrums so that switching of rearwardly inclining modes of the upper back portion can be made. With the chair thus constructed, the sitting person is capable of selecting a desired one of modes including, for example, a mode of rearwardly inclining the upper back portion largely and a mode of rearwardly inclining it with a smaller radius of gyration. Thus, the chair can be more suited to the preference and the like of a person sitting thereon.

Further, the chair may be constructed such that the seat portion or the like is moved in cooperation with the switching of rearwardly inclining modes of the upper back portion. With this construction, it is possible to select a desired mode including movement of the seat portion.

If the chair having the back portion divided into the upper back portion and the lower back portion is constructed to allow the upper back portion to incline rearwardly with the lower back portion being maintained at a predetermined angle, the chair allows the sitting person to bend his or her backbone backwardly thereby refreshing the sitting person.

In the case where the upper back portion is inclined rearwardly relative to the lower back portion, the distance between the upper back portion and the lower back portion changes. To absorb this change in the distance, it is preferred that an upholstery member be attached to a body contacting part of the back portion. The provision of such an upholstery member makes it possible not only to absorb changes in the distance between the upper back portion and the lower back portion but also to make the surface of the whole back portion smooth.

BEST MODE FOR CARRYING OUT THE INVENTION

Figure 1:
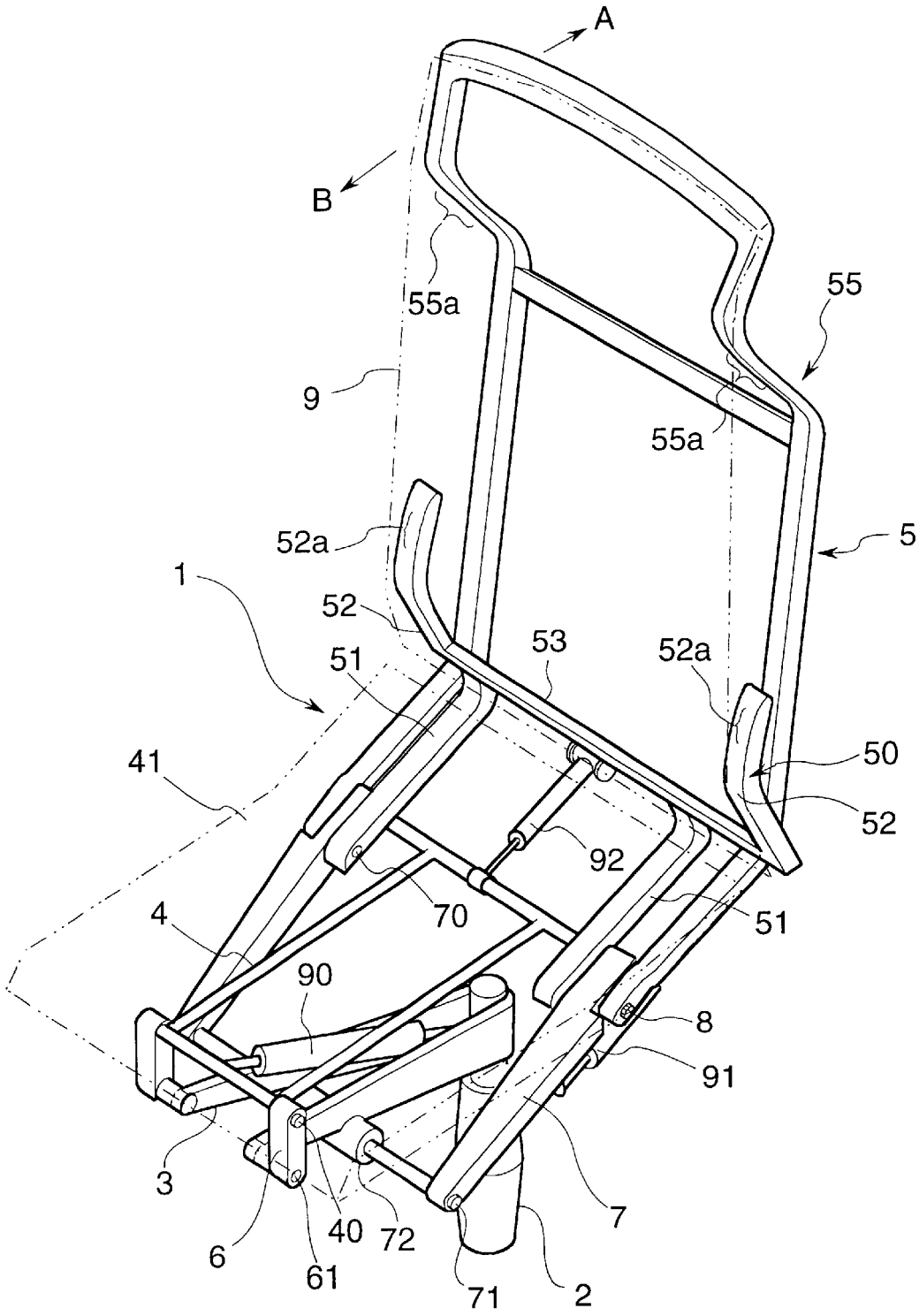
FIG. 1 is a perspective view showing a principal part of a chair representing one embodiment of the present invention.

Hereinafter, one embodiment of the present invention will be described with reference to the drawings. FIG. 1 is a perspective view showing a principal part of a chair 1 representing one embodiment of the present invention. The chair 1 includes a support base 3 mounted on a base leg 2, links 6 and 7 attached to the support base 3, a seat frame 4 forming a seat portion and attached to the links 6 and 7, and a backrest frame 5 comprising a backrest upper frame 55 forming an upper back portion and a backrest lower frame 50 forming a lower back portion. The chair 1 further comprises an upholstery member 9 of cloth or the like mounted to extend between the backrest upper frame 55 and the backrest lower frame 50, and a seat cushion 41 having a seating surface 41*a* on the obverse side thereof and mounted on an upper portion of the seat frame 4.

The support base 3 is constructed of an aluminum member shaped into an inverted triangle and has a lower side attached to the base leg 2 and a front end portion fitted with the links 6 through shafts 61. The links 6 are configured to be rotatably movable by means of shaft 40 and shafts 61 located on opposite sides of a front portion of the seat frame 4. Between the shaft 40 extending between the upper ends of the links 6 and a central portion of the support base 3 is provided a gas spring 90 which can be switched between a fixed state and a free state to vary the inclination of the backrest frame 5 by means of a lever not shown. A torsion bar 72 is provided in a substantially central portion of the support base 3 and each link 7 is fixed at its one end to a shaft 71 extending in the direction of an extension of the torsion bar 72. Each link 7 is constructed of a metal member extending obliquely rearwardly from the shaft 71 and is rotatably attached at its other end to a part flanking a rear portion of the seat frame 4. The spring force of the torsion bar 72 urges shafts 8 located below the seating surface 41a to rotate forwardly of the chair 1 (toward the side B).

On the underside of an upper end portion of the links 7 is provided a gas spring 91 connected to the backrest upper frame 55, the gas spring 91 constantly pressing the backrest upper frame 55 forwardly (toward the side B) by means of its gas pressure. In the vicinity of the gas spring 91 is provided a mechanism for pinching a shaft of the gas spring 91 to fix the same and, hence, the gas spring 91 can be switched between a free state and a fixed state when a lever not shown is operated.

Inside the backrest upper frame 55 is rotatably mounted the backrest lower frame 50 through shafts 70 attached to the links 7. The backrest lower frame 50 comprises ischium-corresponding frames 51 each extending substantially in the direction of an extension of the corresponding link 7, an interconnecting member 53 located on an upper portion of the ischium-corresponding frames 51, and hipbone-corresponding frames 52 located on opposite ends of the interconnecting member 53 to extend substantially perpendicularly upward therefrom. The hipbone-corresponding frames 51 (sic) each have an end portion formed with an arcuately curved portion 52*a* curved toward the rear side of the chair 1 (toward the side A). A gas spring 92 is provided between the interconnecting member 53 and a rear frame of the seat frame 4 located below the interconnecting member 53 for fixing at a predetermined angle. In this embodiment, the gas spring 92 is constantly kept in a fixed state.

On the other hand, the backrest upper frame 55 attached to the shafts 8 becomes rotatable about the shafts 71 together with the links 7 as an integral part when the gas spring 91 located on the underside of the backrest upper frame 55 is switched to the fixed state. Alternatively, when the gas spring 91 is switched to the free state, the backrest upper frame 55 becomes rotatable about the shafts 8. Like the backrest lower frame 50, the backrest upper frame 55 is bent behind the seat frame 4 and extends behind the backrest lower frame 50 from the bent portion to terminate in a curved portion 55*a* at a level adjacent the shoulders of a person sitting on the chair 1.

Figure 2:
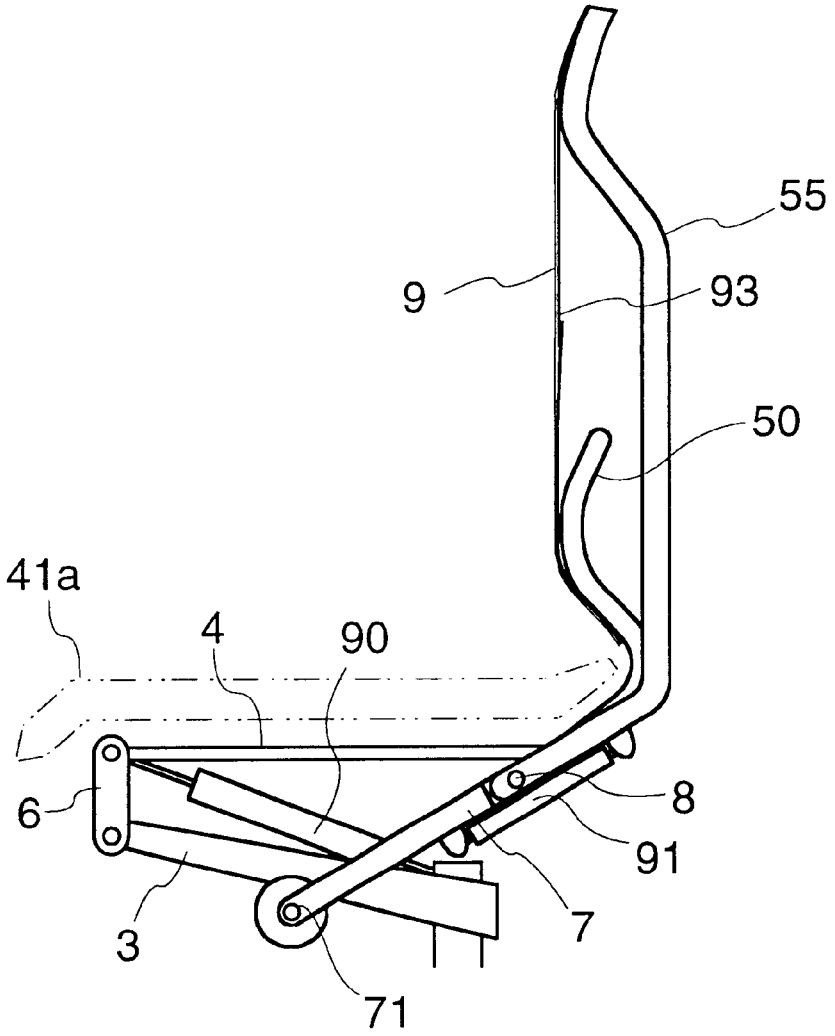
FIG. 2 is a side elevational view of the chair representing the same embodiment in an upright position.

Over the curved portion 55*a* of the backrest upper frame 55 and the curved portion 52*a* of the backrest upper frame 55 is provided a cantilever elastic piece 93 (see FIG. 2) which is bendable over these curved portions, and further the upholstery member 9 is mounted over the elastic piece 93 to cover the backrest upper frame 55 and the backrest lower frame 50.

Next, description is directed to switching between backrest states of the chair 1 thus constructed. Described first is the case where a first state (shown in FIG. 3) is to be assumed which allows the backrest lower frame 50 and the backrest upper frame 55, as an integral part, to incline rearwardly in the direction A with the seat frame 4 rearwardly inclining interlockingly therewith.

In switching a state (shown in FIG. 2) where the backrest lower frame 50 and the seat frame 4 are in the upright position of the chair 1 (namely, a state where a person does not sit on the chair 1 while the gas spring 90 is made free) to the first state (shown in FIG. 3) allowing the whole backrest frame 5 to incline rearwardly, the gas spring 91 is turned into a fixed state, while the gas spring 90 is made free. By so doing, the backrest upper frame 55 together with the links 7, as an integral part, becomes capable of largely rotating about the shafts 71. Interlockingly therewith, a four-member link mechanism comprising the support base 3, links 6, seat frame 4 and links 7 causes the seat frame 4 to incline rearwardly since the gas spring 90 assumes a free state. The backrest lower frame 50 also inclines rearwardly as the links 7 rotate and, hence, the seat frame 4 and the backrest frame 5 move synchronously as a whole.

Alternatively, in switching the state (shown in FIG. 2) where the backrest lower frame 50 and the seat frame 4 are in the upright position of the chair 1 to the second state (shown in FIG. 4) allowing the backrest upper frame 55 to rearwardly incline with a smaller radius of gyration, the gas spring 91 is turned into the free state, while the gas spring 90 located below the seat frame 4 is turned into the fixed state. By so doing, the seat frame 4 and the backrest lower frame 50 are fixed, while only the backrest upper frame 55 becomes capable of rotating about the shafts 8 toward the side A. In this case, the distance between the upper end position of the backrest upper frame 55 and the upper end position of the backrest lower frame 50 changes. However, the upholstery member 9 and elastic piece 93 bend to absorb this change in the distance thereby maintaining the whole backrest portion smooth.

Figure 3:
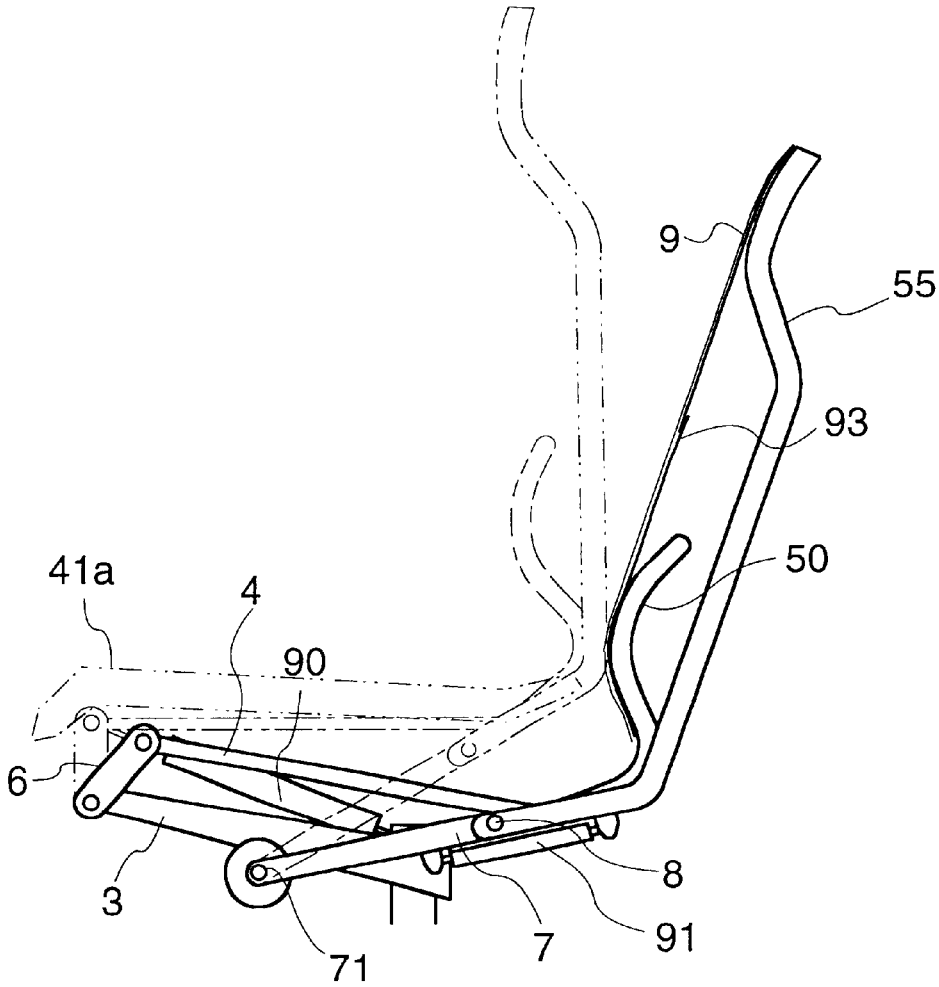
FIG. 3 is a side elevational view representing the same embodiment in a first position.
Figure 4:
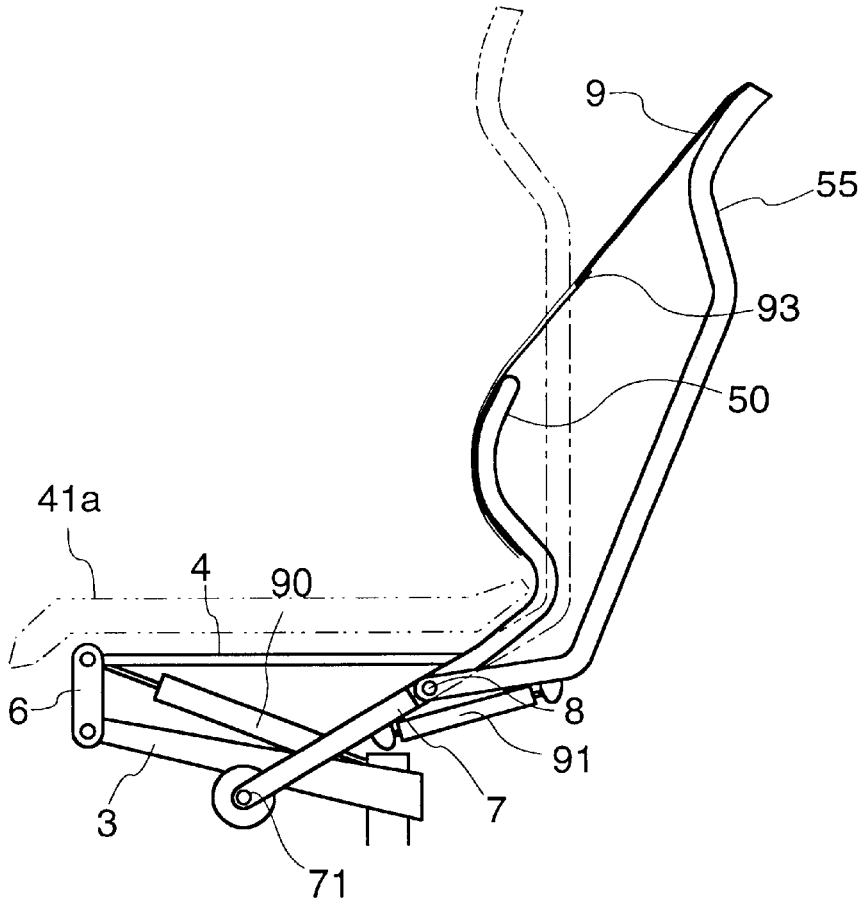
FIG. 4 is a side elevational view representing the same embodiment in a second position.

According to this embodiment of the present invention, the chair 1 wherein the backrest frame 5 is divided into the backrest upper frame 55 and the backrest lower frame 50, at least the backrest upper frame 55 being capable of inclining rearwardly, is of the construction that: the shafts 71 and shafts 8 for rearwardly inclining the backrest upper frame 55 with different radii of gyration are located below the seating surface 41*a*; and switching between the shafts 71 and the shafts 8 allows selection of any desired one of plural rearwardly inclining modes (shown in FIGS. 3 and 4). By this construction, the upper back portion is allowed to move rearwardly while rearwardly inclining gently. Thus, the shoulders and parts therearound of a person sitting on the chair 1 can be stably supported by the upper end side of the upper back portion. Further, the construction allows selection of any desired one of plural rearwardly inclining modes and, hence, the chair can be suited to the preference of a person sitting thereon. Since this embodiment is constructed to allow the backrest upper frame 55 to incline rearwardly with the backrest lower frame 50 being maintained at a predetermined angle, a person sitting on the chair is capable of bending his or her backbone backwardly whereby the person can be refreshed.

Further, since the chair is constructed such that in rearwardly inclining the whole backrest frame 5, the seat frame 4 also rearwardly inclines interlockingly therewith, the hip part of the sitting person can be prevented from slipping when the backrest frame 5 is wholly inclined rearwardly, whereby the chair is made more comfortable to sit.

Furthermore, since the chair 1 has the elastic piece 93 allowing its bending which is mounted to extend between the backrest upper frame 55 and the backrest lower frame 50, and the upholstery member 9 disposed over the elastic piece 93, the bending of the elastic piece 93 and upholstery member 9 can absorb a change in the relative distance between the backrest upper frame 55 and the backrest lower frame 50 if it occurs.

It should be noted that though the backrest lower frame 50 is located inside the backrest upper frame 55, this arrangement may be reversed. Further, though the axis of rotation of the backrest upper frame 55 is changed through switching of the gas spring 91 between the fixed state and the free state, the present invention is not limited to this arrangement and may employ any arrangement which can switch the coupling between the backrest upper frame and the links 7.

Industrial Applicability

The present invention is practiced in the embodiment described above and provides the following effects.

That is, the chair of the present invention wherein the back portion located rearwardly of the seat portion is divided into the upper back portion and the lower back portion, at least the upper back portion being capable of inclining rearwardly, is of the construction that the fulcrum for rearwardly inclining the upper back portion is located below the seating surface, the upper back portion being allowed to incline rearwardly about the fulcrum. By this construction, the upper back portion is allowed to move rearwardly while rearwardly inclining gently, whereby the shoulders and parts therearound of a person sitting on the chair can be contacted and supported by the upper end side of the upper back portion.

What is claimed is:

1. A chair wherein a back portion located rearwardly of a seat portion is divided into an upper back portion and a lower back portion, at least the upper back portion being capable of inclining rearwardly, wherein the upper back portion can be inclined rearwardly relative to the lower back portion thereby to change the distance between an upper end position of the upper back portion and an upper end position of the lower back portion; a plurality of fulcrums for rearwardly inclining the upper back portion with different radii are located below a seating surface; and when one of the plurality of fulcrums is selected, the upper back portion is allowed to incline rearwardly about the fulcrum selected.

2. A chair wherein a back portion located rearwardly of a seat portion is divided into an upper back portion and a lower back portion, at least the upper back portion being capable of inclining rearwardly, wherein the upper back portion can be inclined rearwardly relative to the lower back portion thereby to change the distance between an upper end position of the upper back portion and an upper end position of the lower back portion; a plurality of fulcrums for rearwardly inclining the upper back portion with different radii are located below a seating surface; and switching between the plurality of fulcrums allows selection of one of modes including a mode of rearwardly inclining the upper back portion and the lower back portion as an integral part interlockingly with the seat portion, and a mode of rearwardly inclining the upper back portion relative to the lower back portion.

3. The chair according to claim 1, wherein an upholstery member extending between the upper back portion and the lower back portion is provided.

4. The chair according to claim 2, wherein an upholstery member extending between the upper back portion and the lower back portion is provided.

* * * * *